US005579966A

United States Patent [19]

Krumweide et al.

[11] Patent Number: 5,579,966

[45] Date of Patent: Dec. 3, 1996

[54] HOSE CARRYING APPARATUS

[75] Inventors: Loren D. Krumweide; David N. Miller, both of Escondido, Calif.

[73] Assignee: KM Products, Escondido, Calif.

[21] Appl. No.: 396,467

[22] Filed: Mar. 2, 1995

[51] Int. Cl.[6] ..... A45F 3/04

[52] U.S. Cl. ..... 224/637; 224/259; 224/602; 224/603; 224/645; 294/157

[58] Field of Search ..... 224/158, 159, 224/160, 148, 202, 205, 209, 214, 215, 261, 262; 294/140, 151, 152, 154, 155, 157

[56] References Cited

U.S. PATENT DOCUMENTS

| | | | |
|---|---|---|---|
| 1,302,312 | 4/1919 | Cook | 224/205 |
| 2,266,334 | 12/1941 | Rice | 224/209 |
| 3,035,747 | 5/1962 | Ullrich, Jr. . | |
| 3,378,222 | 4/1968 | Erickson . | |
| 3,722,823 | 3/1973 | Reich et al. . | |
| 3,942,636 | 3/1976 | Matsuyama et al. . | |
| 4,057,757 | 11/1977 | Darden, Jr. | 224/205 |
| 4,685,601 | 8/1987 | Riddling . | |
| 4,739,913 | 4/1988 | Moore | 224/214 |
| 4,762,257 | 8/1988 | Spillers et al. . | |
| 4,858,797 | 8/1989 | Rabska . | |
| 4,972,981 | 11/1990 | Gex | 224/214 |
| 5,012,964 | 5/1991 | Falletta et al. | 224/209 |
| 5,181,638 | 1/1993 | McHale | 224/262 |
| 5,195,596 | 3/1993 | Mount, III et al. . | |

FOREIGN PATENT DOCUMENTS

| | | | |
|---|---|---|---|
| 162448 | 2/1949 | Germany | 224/214 |
| 5076 | 3/1910 | United Kingdom | 224/214 |

*Primary Examiner*—Henry J. Recla
*Assistant Examiner*—Gregory M. Vidovich
*Attorney, Agent, or Firm*—Brown Martin Haller & McClain

[57] ABSTRACT

An apparatus for carrying folded hose, such as fire hose to locations where it is needed. The apparatus is constructed of lightweight, flexible material, such as webbed nylon and is capable of being worn on the back of a person, as a backpack. The apparatus has a U-shaped bottom support panel which supports the bottom and sides of at least one folded hose. The back of the folded hose is supported by a vertical support strap which lies against the back of the person wearing the apparatus. An upper horizontal strap and lower horizontal strap extend from the vertical back support strap around the folded hose to secure the folded hose to the apparatus. At least one anchor strap is attached to the bosom of the apparatus and the lower horizontal strap preventing the folded hose from slipping out of the bottom of the apparatus. The apparatus has two carrying or shoulder straps and a waist strap. The shoulder straps, waist strap and horizontal straps are adjustable. The waist strap and horizontal strap can be fastened and unfastened about the wearer's waist and the folded hose, respectively. Preferably, the apparatus has two upper and two lower horizontal straps and is capable of carrying at least two folded hoses, one in front of the other.

19 Claims, 3 Drawing Sheets

HOSE CARRYING APPARATUS

BACKGROUND OF THE INVENTION

This invention relates generally to carrying apparatuses, and more particularly to apparatuses for carrying hose generally and fire hose specifically. In fighting fires, it is critical that fire hoses be readily transportable from for instance, the fire equipment vehicle to a water source or to the location of the fire for attachment to other hoses. For the sake of efficiency in fighting fires, firefighters are often expected to carry two fire hoses from one location to another. Fire hoses average 100 feet in length and 40 pounds apiece making manipulation of one, let alone two, fire hoses heavy and cumbersome.

One popular method of carrying a fire hose is referred to a "Gasner" or "Cleveland" or "String Pack" method. Generally, the fire hose is first loosely coiled and then fold into a horseshoe shape and bound into its folded coiled shape using straps, often of string. The straps are positioned generally at opposite ends from each other, roughly dividing the folded coiled hose into thirds. The firefighter then places his or her arms through a loop of the hose, which lies between the straps such that the coil of hose hangs behind the firefighter in, loosely, a backpack fashion.

One disadvantage to this method of carrying fire hoses is that if the coil is not tightly bound, it can unravel as the firefighter rushes along with the hoses dangling behind. Additionally, as the firefighter runs with the fire hose hanging behind him or her, even if it does not unravel, the coil swings from side-to-side bumping against the back of the firefighter. As this happens the loop of hose, which is draped over the firefighter's shoulders, tends to slip off the shoulder. This causes an interruption in the effort to transport the hose and uses time that cannot be spared, particularly in a dangerous environment.

Yet another disadvantage to this method of carrying extra fire hose is that when the firefighter reaches the desired location, assuming the hose is still bound, the fire hose must now be unbound by removal of the straps, thus occupying additional time that could be critical. In fact, at times the straps must be cut off the hose, as time is too critical to try to untie the binding.

In part to alleviate the above problems, various devices have been designed to aid the firefighter in transporting fire hoses as necessary. These devices are generally designed to contain a frame within which the fire hose may be carried and thereby supported. Additionally, the designs are intended to allow some freedom of movement for the firefighter so that he or she will be able to handle whatever obstructions or similar distractions present themselves as the firefighter attempts to reach the desired location. Further, these devices are intended to securely bind the folded fire hose thereby avoiding the unravelling problems previously described.

One example of such a device is the portable fire hose described in U.S. Pat. No. 3,942,636, issued to Matsuyama, et al. This portable fire hose is capable of being compactly folded and secured by a wrapping sheet member which is attached to one end of the hose. This permits the firefighter to carry the folded fire hose in one hand or over one shoulder leaving the other hand or both hands free as the firefighter maneuvers to the scene of the fire. Likewise, a fire hose carrying case, described in U.S. Pat. No. 5,195,596, issued to Mount III, et al., is carried over one shoulder. This carrying case straddles one shoulder with a front compartment against the wearer's chest and a rear compartment against the wearer's back, each compartment containing a portion of the fire hose. Both the Matsuyama portable fire hose and the Mount III fire hose carrying case have the disadvantage of unevenly distributing the weight of the fire hose to one side of the firefighter. This makes maneuvering cumbersome as the firefighter's balance is compromised.

Another example of a device designed to aid firefighters in transporting fire hoses is a fire hose backpack described in U.S. Pat. No. 4,685,601, issued to Riddling. The Riddling backpack consists of a solid frame and is designed to be releasably attached to the cylindrical air tank of a self-contained breathing apparatus which is carried on the back of a firefighter. The backpack is secured to the air tank by spring clips which are on a vertical spine of the backpack. The folded fire hose sets in the pack, in a horseshoe shape, across the top end and down either side of the air tank and is secured to the backpack by a combination of flexible straps and rigid horizontal arms. Thus, the Riddling backpack relies on the shoulder harness of the self-contained breathing apparatus for securing the backpack to the firefighter. Furthermore, attaching the loaded backpack to the air tank cylinder requires the aid of another firefighter.

A different fire hose backpack frame, described in U.S. Pat. No. 4,858,797, issued to Rabska, also consists of a rigid, steel or similar metal frame to which at least two spirally coiled fire hoses are secured by two straps which pass through the centers of the spirals and around the top of the coils to attach to the top of the rigid frame. The rigid frame of the backpack includes a cantilever frame member which serves as a shelf-like support for the two coiled fire hoses. This shelf-like cantilever frame member is open in the center such that the fire hoses protrude below the shelf.

While both the Riddling and Rabska backpacks permit the firefighter's hands to remain free, the rigid construction of the frames adds weight and inflexibility to the firefighter. In the Riddling device, the rigid backpack apparatus is entirely supported by the air tank cylinder of the self-contained breathing apparatus; thus, a significant portion of the weight of the pack is on the center of the firefighter's back. In the Rabska device, the rigid frame sets against the back of the firefighter thereby limiting his or her movement.

Therefore, it is an object herein to provide a lightweight, flexible apparatus for carrying at least one folded hose, particularly at least one folded fire hose. It is also an object to provide a flexible fire hose carrying apparatus, that can be worn as a backpack, which securely holds at least one and preferably two folded fire hoses on the back of a firefighter. Still other objects will become apparent from the more detailed description which follows.

SUMMARY OF THE INVENTION

A flexible apparatus for carrying at least one folded hose is provided herein. In a preferred embodiment, the apparatus is particularly adapted for carrying at least one folded fire hose and preferably two folded fire hoses, and contains at least one vertical carrying strap. In a particularly preferred embodiment the flexible apparatus contains a pair of adjustable vertical carrying straps such that the apparatus may be worn on the shoulders of a person as a backpack. In the particularly preferred embodiment the flexible material backpack contains inner releasable upper and inner releasable lower horizontal straps to secure a first folded fire hose in the pack and outer releasable upper and outer releasable lower horizontal straps to secure a second folded fire hose in the pack in front of the first folded fire hose. Additionally, preferred embodiments contain a releasable waist strap which secures the backpack apparatus about the wearer's waist.

In specific embodiments the entire apparatus, save the fastening means, is constructed of nylon webbing and Cordura nylon, additionally the inner and outer releasable horizontal straps are distinguished from one another by color. Further, in specific embodiments, the fastening means are constructed of lightweight, sturdy material such as plastic.

BRIEF DESCRIPTION OF THE DRAWINGS

The present disclosure will be better understood from the following detailed description, taken in conjunction with the accompanying drawings, in which like reference numerals refer to like parts, and in which.

DETAILED DESCRIPTION OF THE INVENTION

Figure 2:
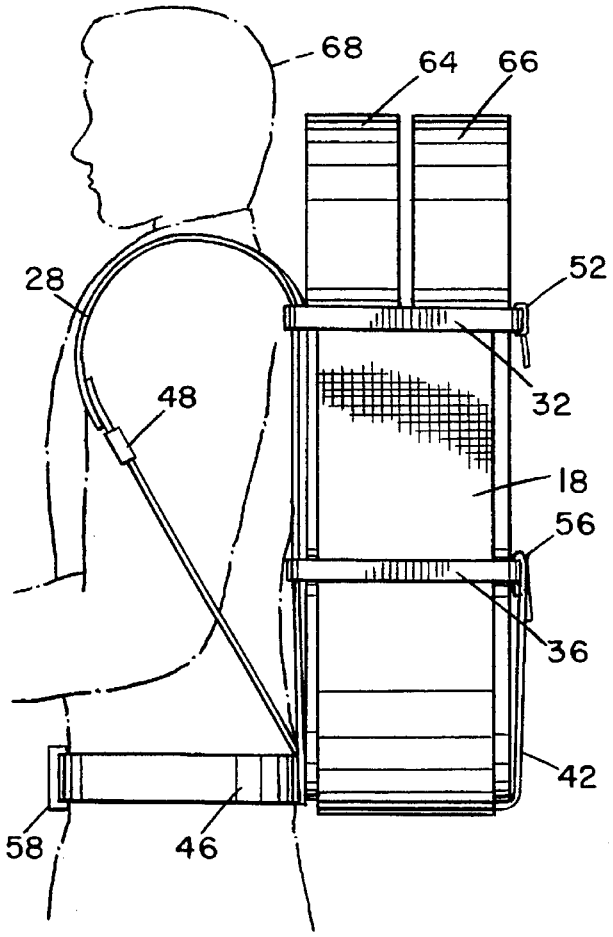
FIG. 2 is a side view showing the apparatus of FIG. 1 as worn on the back of a person, with two folded hoses in place.

As used herein, the "back" of the carrying apparatus is that portion which lies against the back of a person wearing the apparatus in a backpack fashion, see for example FIG. 2. The "front" of the carrying apparatus, as used herein, refers to that portion which is furthest from the back of a wearer and behind the wearer. Thus, referring to FIG. 2, which illustrates a preferred embodiment, a first folded hose 64 is in back of a second folded hose 66. Further, as used herein, the "top" of the apparatus is that portion nearest the head of a wearer and the "bottom" is that portion furthest from the head of a wearer, again see FIG. 2 wherein a preferred embodiment is illustrated.

Figure 1:
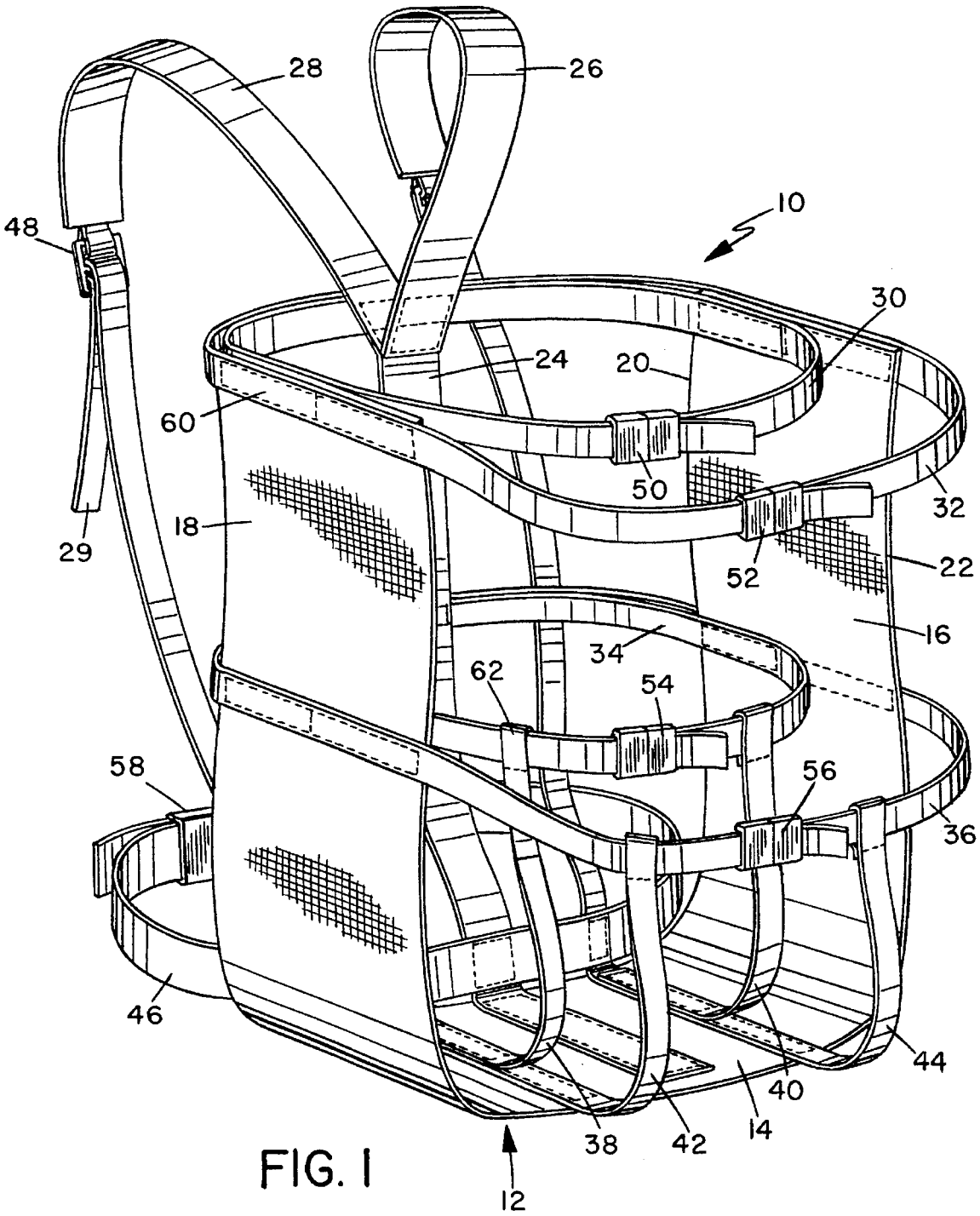
FIG. 1 is a perspective view of a preferred embodiment of the hose carrying apparatus.
Figure 3:
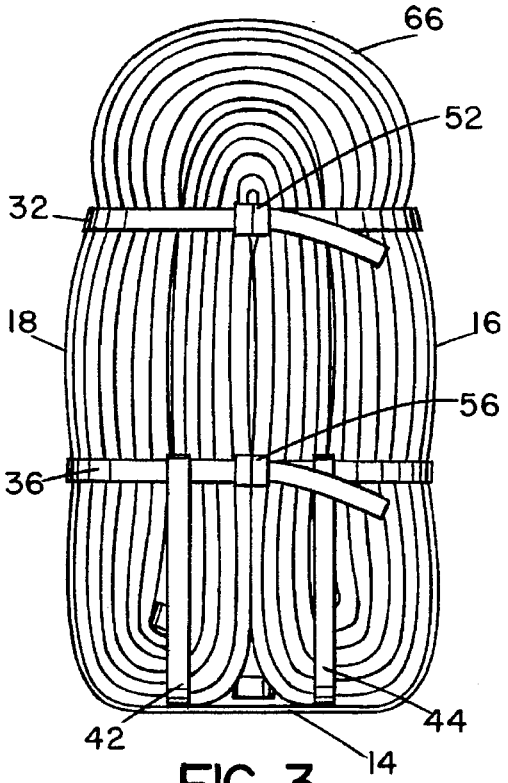
FIG. 3 is a rear view of the apparatus as shown in FIG. 2.

Additionally, as used herein, the "inside" of the carrying apparatus is that area within which the folded hose or hoses sets. Referring to FIGS. 1 and 3, the inside of that apparatus is the area defined by the vertical back support strap 24, the U-shaped bottom support panel 12 and the outer lower horizontal strap 36 and attached anchor straps 42 & 44. The "outer side" of the apparatus, as used herein is that which is not defined as "inside".

Furthermore, as used herein, the "width" of the U-shaped bottom support panel 12 is the shortest distance from a point on the first edge 20 of the panel, across the panel, to its second edge 22.

Figure 4:
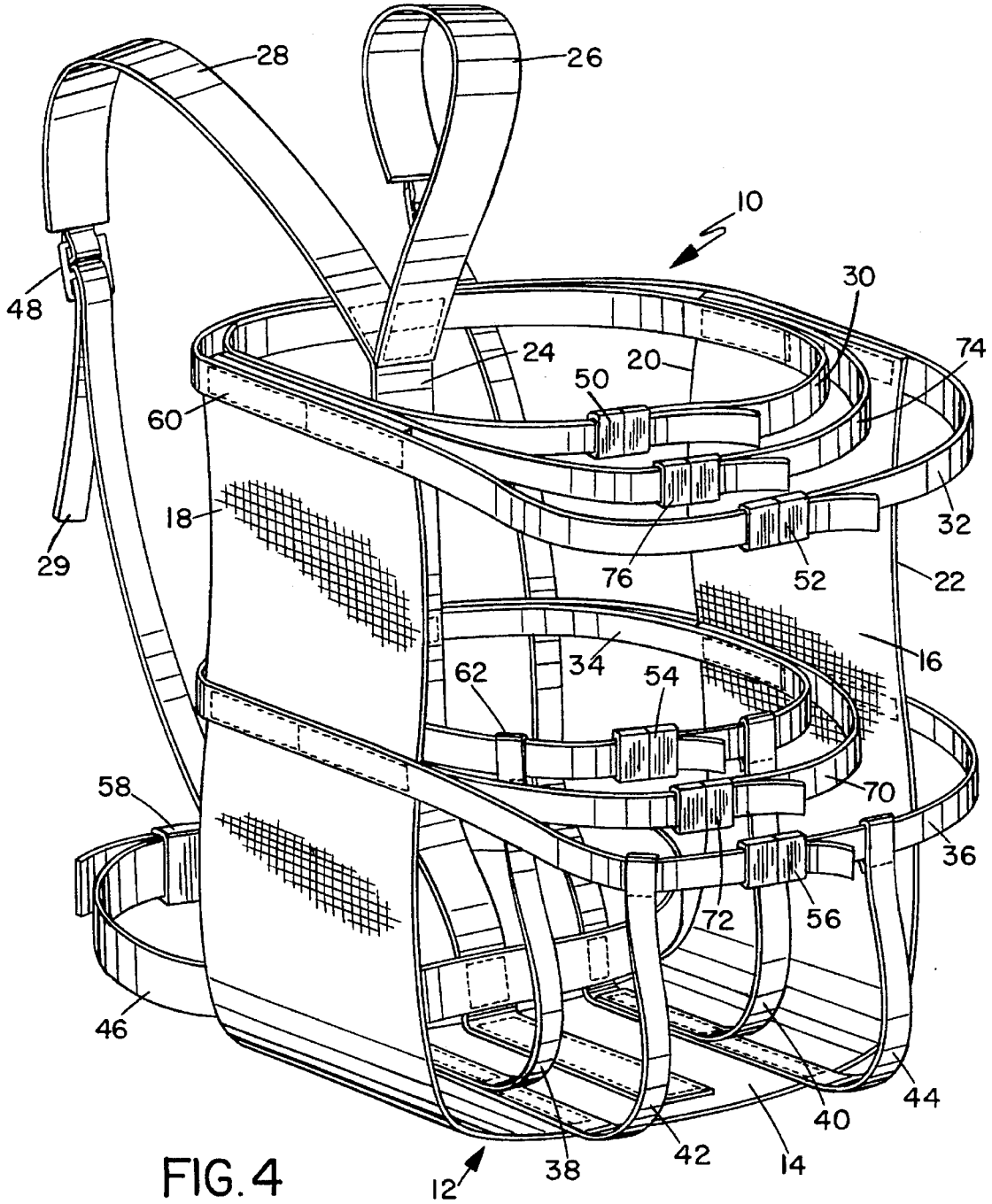
FIG. 4 is a perspective view of an alternative preferred embodiment of the hose carrying apparatus.

A flexible carrying apparatus 10, according to a preferred embodiment, for carrying up to two folded fire hoses 64 & 66 in a backpack fashion, is illustrated in FIGS. 1–3. FIG. 4 illustrates an alternative embodiment of the hose carrying apparatus of FIG. 1, being adapted to carry up to three folded hoses. Referring generally to FIG. 1, the flexible material apparatus 10 basically comprises a system of straps, for example 30, 34, 26 and 28, and supports, for example 12 and 24, which hold up to two folded fire hoses 64 & 66, shown in FIG. 2, in a secure manner yet without the excess weight or bulk contributed by conventional carrying apparatuses. In greater detail, the apparatus consists of a U-shaped bottom support panel 12 which has three supportive sides: a flat horizontal bottom portion 14, a right side or portion 16 and a left side or portion 18. In this preferred embodiment, the U-shaped bottom support panel 12 is constructed of a single piece of webbed nylon. Thus, the U-shaped bottom support panel has a first edge 20 which is continuous along all three supportive sides 14, 16 & 18 and a second edge 22, also continuous along all three supportive sides. However it will be appreciated that other embodiments, such as two or three panels attached to one another to form the U-shaped bottom support panel, are likewise contemplated.

Attached to the first edge 20 of the U-shaped bottom support panel is a vertical support strap 24. This strap lies against the back of the wearer, in between the wearer and the first folded hose 64. The vertical support strap 24 is attached by its bottom end to the flat horizontal portion 14 of the U-shaped bottom support panel. At its top end, the vertical support strap is attached to a pair of shoulder straps 26 & 28 and/or to the upper inner 30 and/or upper outer horizontal straps 32.

The shoulder straps 26 & 28, or more generally vertical carrying straps, are attached by their lower end to the flat horizontal bottom portion 14 of the U-shaped bottom support panel. In the preferred embodiment illustrated by the Figures, each shoulder strap consists of two lengths of webbed nylon which are attached to one another by a sturdy plastic buckle 48. The top length of shoulder strap is non-releasably attached to one end of the buckle 48 by a loop of webbing stitched securely to the top length strap. The bottom length of shoulder strap is looped through the other end of the buckle with the free end 29 available for adjusting the length of the shoulder strap.

It will be appreciated that other embodiments, such as a single vertical carrying strap or non-adjustable vertical strap(s) are likewise contemplated herein. By way of example only, if a single vertical carrying strap is present, the apparatus can be carried over one shoulder in a satchel manner such that the apparatus hangs on one side of the wearer, or it can be carried over one shoulder and the head in a sling manner such that the carrying strap crosses the wearer's chest or back.

In the preferred embodiment, as illustrated, two upper horizontal straps, an inner or first horizontal strap 30 and an outer or second horizontal strap 32, are attached to the top of the apparatus, at the point where the top end of the vertical support strap 24 and the upper ends of the shoulder straps 26 & 28 are joined. The upper inner horizontal strap 30 is attached to the inside of the apparatus along about half of the top edge of the right side 16 and left side 18 of the U-shaped bottom support panel 12. Each end of the upper inner horizontal strap is looped through one half of a sturdy plastic, quick-release side-squeeze buckle 50. Thus, when a folded hose is loaded into the apparatus, the two ends of buckle 50 are secured to one another and the strap is tightened around the hose by pulling on the free ends of the strap; thereby forming a loop about the folded fire hose.

The outer upper horizontal strap 32, of this preferred embodiment, is likewise attached to the top of the apparatus as described above. This strap is attached, however, for the full length of the outside of the top edge of the right side 16 and left side 18 of the U-shaped bottom support panel 12, as illustrated by the stitching demarcations 60 in FIG. 1. The outer upper horizontal strap has a same adjustable fastening means 52 as described for the inner upper horizontal strap. Further, the outer upper horizontal strap extends forwardly from the U-shaped bottom support panel such that a second folded hose can be securely positioned in front of a first folded hose. For example, see FIG. 2 wherein two folded hoses 64 & 66 loaded into the apparatus are illustrated.

It will be appreciated that alternative embodiments are contemplated. For example, the upper horizontal straps may each be attached to the U-shaped bottom support panel in a continuous or interrupted loop. Where a horizontal strap is attached to the apparatus in a non-continuous or interrupted loop, the parts of the apparatus to which the horizontal strap is connected complete the loop. Likewise other contemplated alternative embodiments include, for example, the apparatus wherein either the inner or outer horizontal strap may alone be attached to the vertical support strap or vertical carrying straps; or either or both horizontal strap may lack a fastening means.

In addition to the two upper horizontal straps 30 & 32, the preferred embodiment shown in the Figures has two lower horizontal straps 34 & 36. These lower horizontal straps are attached to one another and to the vertical back support strap 24 at a point on the vertical back support strap between the upper horizontal straps and the flat horizontal bottom portion 14 of the U-shaped bottom support panel 12. Preferably, the lower horizontal straps are attached approximately midway between these two points. The inner or first lower horizontal strap 34, like the inner upper horizontal strap is attached to the inside of the apparatus along about half width of the right side 16 and left side 18 of the U-shaped bottom support panel 12. Additionally, the inner lower horizontal strap is attached to the same type of sturdy plastic, quick-release side-squeeze buckle 54 described above as being attached to the upper horizontal straps.

Similar to the outer upper horizontal strap, the outer or second lower horizontal strap 36 is attached along the full width of the outside of the right side 16 and left side 18 of the U-shaped bottom support panel 12. The outer lower horizontal strap also is attached by its two ends to a buckle 56 as previously described. Thus, two folded hoses can be loaded into the apparatus, in tandem. The first hose is against the back of the apparatus secured by the inner upper 30 and inner lower 34 horizontal straps and the second folded hose is in front of the first folded hose secured by the outer upper 32 and outer lower 36 horizontal straps. FIG. 2 illustrates the apparatus so loaded, with two folded hoses 64 & 66 in tandem.

Again, it will be appreciated that other embodiments, such as those described with respect to the upper inner and upper outer horizontal straps, are likewise contemplated with respect to the lower horizontal straps. Furthermore, other alternatives to the illustrated, preferred embodiment will be appreciated, for example a single horizontal strap for securing a hose or hoses in the apparatus; a single pair of horizontal straps for securing the hose(s); or three pairs of straps, that is inner, middle and outer upper and lower straps, for securing up to three hoses in the apparatus, as illustrated in FIG. 4.

Referring briefly to FIG. 4, an alternative embodiment of the hose carrying apparatus is illustrated. This embodiment is adapted to carry up to three hoses by addition of a middle upper horizontal strap 74 between the inner upper horizontal strap 30 and outer upper horizontal strap 32 and addition of a middle lower horizontal strap 70 between the inner lower horizontal strap 34 and the outer lower horizontal strap 36. Both the middle upper horizontal strap 74 and middle lower horizontal strap 70 are illustrated with sturdy plastic, quick-release side-squeeze buckles 76, 72 like those previously described with respect to the upper inner and outer horizontal straps (buckles 50 and 52) and lower inner and outer horizontal straps (buckles 54 and 56).

Referring again, generally to FIG. 1, additional support is provided to the apparatus by the four anchor straps 38, 40, 42 & 44 which are attached to the lower horizontal straps. In the illustrated, preferred embodiment, the inner two anchor straps 38 & 40 are each continuous with the shoulder straps 28 & 26, respectively. Thus, the left shoulder strap 28 is attached to the inside of the flat horizontal bottom portion 14 of the U-shaped bottom support panel 12 for about half the width of the flat horizontal bottom portion 14. The left shoulder strap 28 then curves upward to attach to the inner lower horizontal strap by looping back on itself 62 such that one end of the inner lower horizontal strap passes through the looped end of the anchor strap 38. Similarly, the right shoulder strap 26 is attached to the inside of the flat horizontal bottom portion 14 and curves upward, looping back on itself, to permit the other end of the inner lower horizontal strap to pass through. Significant strength is added to the apparatus by using this configuration.

The two outer anchor straps 42 & 44 are also attached to the inside of the flat horizontal bottom portion 14 of the U-shaped bottom support panel 12, but for the entire width of the flat horizontal bottom portion. These straps extend forward past the second edge 22 of the flat horizontal bottom portion 14 then curve upward to attach to the outer lower horizontal strap 36 by the same loop method described for the inner anchor straps. The outer anchor straps are spaced, like the inner anchor straps, such that each end of the lower horizontal strap passes through the loop of one anchor strap. Thus, when the apparatus is loaded with two folded hoses, the bottom portion of the first folded hose is securely positioned against the back of the apparatus by the inner lower horizontal strap 34 and the two inner anchor straps 38 & 40 and the second folded hose is securely positioned in front of and against the first folded hose by the outer lower horizontal strap and the two outer anchor straps. FIGS. 2 and 3 illustrate two views of the apparatus so loaded with a first folded hose 64 and a second folded hose 66.

In order to more tightly secure the loaded apparatus onto the back of a wearer 68, the apparatus has a waist strap 46, which may be releasably fastened and adjusted about the waist of the wearer. See, for example FIG. 2. The waist strap 46 is attached, at the bottom of the apparatus, to three points; to the vertical back support strap 24, to the right shoulder strap 26 and to the left shoulder strap 28. Each attachment is just above the point where the vertical strap 24 or shoulder strap 26 & 28 is attached to the flat horizontal bottom portion 14 of the U-shaped bottom support panel 12. Additionally, each end of the waist strap 46 is looped through one half of a sturdy plastic, quick-release side-squeeze snap buckle 58, such that the waist strap can be fastened about the waist of the wearer and adjusted by pulling on either free end of the waist strap.

Thus, when the apparatus is fully loaded and secured to the back of a wearer, the weight of the apparatus is distributed to the shoulders, waist or hips and back of the wearer. Because the folded hoses are tightly held in the apparatus and the apparatus is securely positioned on the body of the wearer, the wearer has a great deal of freedom of movement. When the firefighter runs to the scene of a fire with the loaded apparatus on his or her back, neither the apparatus nor the individual hoses will fall, shift or swing so as to impede the firefighter's motion.

While the illustrated, preferred embodiment is thus described, other embodiments are understood as likewise encompassed herein and limited only by the attached claims. Examples of other contemplated embodiments include, the use of alternative fastening and adjusting means on the shoulder straps 26 & 28, the horizontal straps 30, 32, 34 & 36 and the waist strap 46 of the apparatus, such as, for example Velcro closures, buttons, snaps or non-plastic buckles. Similary any or all of the adjusting and/or fastening means could be removed from the apparatus with the respective ends permanently secured to one another. For example, if no fastening or adjusting means were included, the folded hoses would be slid into place and the wearer of the apparatus would either step into the apparatus or pull it on over his or her head.

Another example of an embodiment understood to be covered herein is an apparatus with only one upper and one lower horizontal strap, positioned either to secure only one folded hose or more than one folded hose. A variation, for example would be an apparatus containing only a single horizontal strap. Similarly, the addition of horizontal straps is a contemplated variation of the apparatus as described.

Other examples of alternative embodiments of the hose carrying apparatus described herein include a vertical back support strap which is wide enough to cover the entire back of the apparatus including, for example being attached to the right side 16, left side 18 and bottom portion 14 of the U-shaped horizontal bottom support panel. Similarly, a panel to extend over the top of the apparatus and cover the top of the loaded hose(s) or a panel extending from the front of the apparatus and covering the front of the loaded hose, are considered variations of the apparatus as described.

Thus, although a preferred embodiment of the present invention has been described above by way of example only, it will be understood by those skilled in the field that modifications may be made to the disclosed embodiment without departing from the scope of the disclosure, which is defined by the claims which follow.

What is claimed is:

1. A flexible apparatus for carrying at least one folded hose comprising:

(a) a U-shaped bottom support panel adapted to support the at least one-folded hose having a flat horizontal bottom portion, a left side and a right side, all of which have a first edge and a second edge, wherein said left side and said right side curve upward, forming the sides of said U-shaped bottom support panel such that the at least one folded hose setting inside said apparatus contacts at least said flat horizontal bottom portion and said right side and left side of said U-shaped horizontal bottom support panel;

(b) a vertical back-support strap having a top back-support end and a bottom back-support end, wherein the bottom back-support end is attached to said flat horizontal bottom of said U-shaped bottom support panel along said first edge midway between said right side and said left side;

(c) at least one vertical carrying strap having an upper carrying-strap edge and a lower carrying-strap edge wherein the upper carrying-strap edge is attached to said top back-support end of said vertical back-support strap and the lower carrying-strap edge of said vertical back-support strap is attached to said first edge of said flat horizontal bottom portion of said U-shaped bottom support panel;

(d) a first upper horizontal strap having two ends which are attached to one another thereby forming an upper loop, wherein said upper loop is attached to said top back-support end of said vertical back-support strap and additionally attached to said right side and said left side of said U-shaped bottom support panel and wherein said loop is of sufficient circumference to encircle the at least one folded hose;

(e) a first lower horizontal strap having two ends which are attached to one another thereby forming a lower loop, wherein said lower loop is attached to said vertical back-support strap at a point between said upper horizontal strap and said flat horizontal bottom portion of said U-shaped bottom support panel and is additionally attached to said right side and said left side of said U-shaped bottom support panel and wherein said lower loop is of sufficient circumference to encircle the at least one folded hose; and (f) at least one anchor strap attached to said first lower horizontal strap wherein said at least one anchor strap extends from said lower horizontal strap to operatively attach to said flat horizontal bottom portion of said U-shaped bottom support panel.

2. The apparatus of claim 1, wherein said right side and said left side of said U-shaped bottom support panel extend upward and attach to said first upper horizontal strap such that said first upper horizontal strap and said flat horizontal bottom portion of said U-shaped bottom support panel are generally parallel.

3. The apparatus of claim 1, further comprising two vertical carrying straps, each attached to said top back-support end of said vertical back-support strap by its upper carrying-strap edge and each attached to said first edge of said flat horizontal bottom portion of said U-shaped bottom support panel by its lower carrying-strap edge.

4. The apparatus of claim 1, further comprising a means for adjusting the length of said at least one vertical carrying strap.

5. The apparatus of claim 1, further comprising a means for releasably fastening the at least one first upper horizontal strap about said folded hose.

6. The apparatus of claim 1, further comprising a means for releasably fastening said two ends of said first lower horizontal strap about the at least one folded hose.

7. The apparatus of claim 1, further comprising a second upper horizontal strap attached to said top back-support end of said vertical back support strap such that said apparatus is thereby adapted to secure, in tandem, at least two folded hoses.

8. The apparatus of claim 1, further comprising a second lower horizontal strap attached to said vertical back-support strap and to said right side and left side of said U-shaped bottom support panel such that said apparatus is thereby adapted to secure, in tandem, at least two folded hoses.

9. The apparatus of claim 1, further comprising a horizontal waist strap attached to said bottom back-support end at about the point where said bottom back-support end attaches to said first edge of said flat horizontal bottom portion.

10. The apparatus of claim 9, further comprising means for adjustably, releasably fastening said waist strap about the waist of a person wearing said apparatus with said vertical carrying straps over their shoulders as a backpack.

11. A flexible material backpack for carrying at least two folded fire hoses comprising:

(a) a U-shaped bottom support panel having a bottom portion for supporting the lower ends of the at least two folded hoses, one right portion for supporting the right side of the at least two folded hoses and one left portion for supporting the left side of the at least two folded hoses;

(b) a back support strap having a top end and a bottom end and being attached to said bottom portion of said U-shaped bottom support panel by said bottom end;

(c) an inner upper horizontal support strap having one inner right end and one inner left end and being attached to said top end of said back support strap at a point midway between said one inner right end and said one inner left end and being additionally attached to said right side and said left side of said U-shaped support panel such that said inner upper horizontal strap encircles one of said at least two folded fire hoses within said backpack;

(d) an outer upper horizontal support strap having one outer right end and one outer left end and being attached to said top end of said back support strap at a point midway between said outer right end and said outer left end and being additionally attached to said right side and left side of said U-shaped support panel such that said outer upper horizontal strap encircles two of said at least two folded fire hoses within said backpack;

(e) an inner lower horizontal support strap having an inner lower right end and an inner lower left end wherein said inner lower horizontal support strap is attached, midway between said inner lower right end and said outer lower left end, to said back support strap at a point between said top end and said bottom end and wherein said inner lower horizontal support strap is additionally attached to said right side and said left side of said U-shaped support panel such that said inner lower horizontal strap encircles one of said at least two folded fire hoses within said backpack;

(f) an outer lower horizontal support strap having an outer lower right end and an outer lower left end wherein said outer lower horizontal support strap is attached, midway between said outer lower right end and said outer lower left end, to said back support strap at a point between said top end and said bottom end and wherein said outer lower horizontal support strap is additionally attached to said right side and said left side of said U-shaped support panel such that said outer lower horizontal strap encircles two of said at least two folded fire hoses within said backpack;

(g) an anchor strap attached to one of said lower horizontal straps wherein said anchor strap extends from said lower horizontal strap to be operatively attach to said bottom portion of said U-shaped bottom support panel;

(h) a pair of shoulder straps, each having an upper end and a lower end and being attached by each of said upper ends to said top end of said back support strap and by each of said lower ends to said bottom portion of said U-shaped bottom support panel wherein said pair of shoulder straps are adapted to extend over a wearer's shoulders to support said backpack on said wearer's back; and (i) a waist strap, having one right edge and one left edge and being attached proximate to said bottom end of said back support strap midway between said right edge and said left edge and being additionally attached to a portion of said shoulder straps, respectively, proximate to said lower ends wherein said waist strap is adapted to encircle the waist of said wearer of said backpack.

12. The backpack of claim 11 further comprising a means for releasably fastening said right end of said inner upper horizontal support strap to said left end of said inner upper horizontal support strap.

13. The backpack of claim 11 further comprising a means for releasably fastening said right end of said outer upper horizontal support strap to said left end of said outer upper horizontal support strap.

14. The backpack of claim 11 further comprising a means for releasably fastening said right end of said inner lower horizontal support strap to said left end of said inner lower horizontal support strap.

15. The backpack of claim 11 further comprising a means for releasably fastening said right end of said outer lower horizontal support strap to said left end of said outer lower horizontal support strap.

16. The backpack of claim 11 further comprising separate means for adjusting the length of each of said shoulder straps such that said shoulder straps may be adjusted by said wearer of said backpack.

17. The backpack of claim 11 further comprising a means for adjustably, releasably fastening the right edge of said waist strap to the left edge of said waist strap.

18. A backpack and fire hose assembly, comprising:

at least one fire hose assembly;

a retainer assembly of flexible material for releasably holding said at least one hose assembly, the retainer assembly forming an enclosure for receiving said at least one hose assembly and having a base support for supporting a lower end of said at least one hose assembly, a rear support and at least one retainer strap extending forwardly from the rear support at a location spaced above the base support and adapted to encircle said at least one hose assembly in an orientation parallel to the base support; and a shoulder strap assembly secured to the retainer assembly for extending over a wearer's shoulders to support the retainer assembly on a wearer's back.

19. The apparatus of claim 11, adapted to carry at least three folded hoses, further comprising:

at least one middle upper horizontal strap situated between said inner upper horizontal strap and said outer upper horizontal strap; and at least one middle lower horizontal strap situated between said inner lower horizontal strap and said outer lower horizontal strap.

* * * * *